US011288910B1

(12) United States Patent
de Azevedo Silveira

(10) Patent No.: US 11,288,910 B1
(45) Date of Patent: Mar. 29, 2022

(54) ILLUSION MACHINE

(71) Applicant: Guilherme de Azevedo Silveira, São Paulo (BR)

(72) Inventor: Guilherme de Azevedo Silveira, São Paulo (BR)

( * ) Notice: Subject to any disclaimer, the term of this patent is extended or adjusted under 35 U.S.C. 154(b) by 0 days.

(21) Appl. No.: 17/355,413

(22) Filed: Jun. 23, 2021

(51) Int. Cl.
*G07C 15/00* (2006.01)
*A63F 11/00* (2006.01)
*A63F 9/34* (2006.01)

(52) U.S. Cl.
CPC ..... *G07C 15/001* (2013.01); *A63F 9/34* (2013.01); *A63F 11/0011* (2013.01)

(58) Field of Classification Search
CPC .... G07C 15/00; G07C 15/001; G07C 15/003; A63F 3/06; A63F 3/062; A63F 7/047; A63F 7/048; A63F 9/34; A63F 11/0011
USPC ..... 273/144 B, 144 R, 144 A, 138.2
See application file for complete search history.

(56) References Cited

U.S. PATENT DOCUMENTS 2,203,886 A * 6/1940 Zamora ..... G07C 15/001 273/144 A
2,746,204 A * 5/1956 Karpf ..... A63H 37/00 446/27
3,140,875 A * 7/1964 Abbott ..... G07C 15/001 273/144 B
4,142,720 A * 3/1979 Davis ..... A63B 37/00 473/53
4,616,831 A * 10/1986 Testerman ..... G07C 15/001 273/144 B
4,699,382 A * 10/1987 Kabana ..... G07C 15/001 273/144 B
4,813,676 A * 3/1989 Weatherspoon ..... A63F 7/048 273/144 A
4,871,171 A * 10/1989 Rivero ..... G07C 15/001 463/20
4,892,310 A * 1/1990 Patterson ..... A63F 7/048 273/144 A
5,062,635 A * 11/1991 Tse ..... A63F 7/048 273/144 A
5,725,212 A * 3/1998 Garrett ..... A63F 7/045 273/138.2
5,779,552 A * 7/1998 Gelfond ..... A63H 23/08 472/67
7,413,511 B2 * 8/2008 Seelig ..... G07F 17/3213 273/138.2

(Continued)

*Primary Examiner* — Joseph B Baldori
(74) *Attorney, Agent, or Firm* — Thomas | Horstemeyer, LLP

(57) ABSTRACT

The present disclosure relates to an ensemble comprising four distinct modules and focuses on the illusionist market. It is an illusion machine that creates the illusion of randomness, when it is actually a deterministic event. The first module includes an element that is in fact a set of elements (spheres or the like) and comprises elements printed in 3D, or by another form of production. The second module consists of an element very similar to the first one, with the difference that it comprises a magnetic core (or any material allowing a similar effect). The ensemble also comprises a third module, a ball globe that should not be completely made of ferromagnetic metal. The fourth module is the trap for the elements. In the proposed device, a trap is used, which is also printed as an integer object, without the need for joint welds, with a built-in magnet.

17 Claims, 4 Drawing Sheets

(56) References Cited

U.S. PATENT DOCUMENTS

| | | | | |
|---|---|---|---|---|
| 7,708,630 | B2 * | 5/2010 | Nicely | G07F 17/3288 463/17 |
| 7,770,892 | B2 * | 8/2010 | Seelig | G07F 17/3202 273/144 B |
| 8,128,089 | B2 * | 3/2012 | Erickson | A63F 3/0645 273/144 A |
| 8,393,946 | B2 * | 3/2013 | Katz | G07F 17/3248 463/16 |
| 9,498,702 | B2 * | 11/2016 | Franco | A63F 7/048 |
| 9,741,192 | B2 * | 8/2017 | Franco | G07C 15/001 |
| 2009/0001663 | A1 * | 1/2009 | Franco Munoz | G07F 17/3202 273/144 A |
| 2020/0054937 | A1 * | 2/2020 | Cao | A63F 9/0838 |

* cited by examiner

ILLUSION MACHINE

FIELD OF THE INVENTION

The present invention refers to a device that is an ensemble comprising four distinct elements and focuses on the illusionist market. It is an illusion machine that creates the illusion of randomness when, in fact, it corresponds to a series of deterministic events.

BACKGROUND

In the illusionist market, several devices or procedures are used to force a choice of a volunteer. The volunteer believes that a free choice was made, when it was not. For example, an automatic deck scrambler can always keep the first or last card in place, allowing the illusionist to create a perception of randomness, while actually partially controlling the outcome of an event.

Lottery, bingo, and similar machines are traditionally embodied as see-through cages where several elements (such as spheres) are placed inside. One element comes out of the machine at a time through a trap. In a non-illusion context, all elements contain a different marking, such as different numbers or words. These machines utilize a fair process that uses, for example, the force of gravity so that one element falls into a trap, and this result is called the chosen element.

To force the result of such a machine, as of today, there are two options. For example, suppose the need to force the resulting element with the number five. The first approach requires the illusionist to place only elements with some kind of pattern inside the machine. In the example given, the simplest pattern is to have the number five written in all elements. The problem with any such approach is that no one will be able to visually inspect the elements placed inside the machine, neither before nor after the selection was made, as the elements will all have a pattern that delivers the desired result by the illusionist.

Other common patterns are to use words with the same starting letter, or numbers that follow a specific pattern such as palindromes, having a specific remainder of a division etc.

A second problem with such approaches is that no one can take in their hands any random element inserted in the machine as they will also be able to realize the pattern contained within them.

A second approach is to use custom elements which can be visually or remotely identified by another device placed within the machine. Technologies such as near field communication can be used to detect when a specific item is close to or at the trap. This approach has not been used in the context of illusions since it presents four problems.

First, this method does not allow the volunteer to say when to stop, since the machine must determine itself when to stop. The second problem consists in having electronic parts in the machine, which requires power and removes the illusion atmosphere since most spectators nowadays understand that electronic parts can achieve results beyond their comprehension. Third, if the electronic parts are hidden inside the machine, but its weight is heavier than a traditional one, volunteers would not be able to examine it. Because illusionists work in a variety of situations, such as at tables in restaurants, where they do not have control over their environment, even if the machine weight is similar to a traditional one, whilst the components are kept outside of the machine and the volunteers sight, it would not be portable and require a setup at their environment, which is applicable only to magicians performing at theaters.

To create a stronger illusion of randomness, it is necessary that the elements inside the machine are indeed of all varieties, and that they can be visually inspected, loaded into the machine and manually manipulated by the volunteers, both before and after the selection process. It also requires it to be light, portable, not use any electronic devices, visible or not, and be examinable by an extra volunteer. The methods of the related art do not allow such an approach since they force a pattern that volunteers analyzing the available markings perceive said pattern, or they utilize electronic components that are either visible, bulky, or require setting up an environment prior to the performance.

U.S. Patent Publication No. 2010210347 refers to a gaming system provided with a display device for generating display events, such as a jumbled ball selection, that represent gaming outcomes at one or more gaming devices. In order that the display device may be located remotely from the gaming devices, a video camera may be provided to capture video of display events at the display device. The gaming devices receive the display event videos and play the display event videos on video displays of the gaming devices. Videos may be provided as live video feeds from the video camera or the video camera may store video files of display events that may be indexed and retrieved when required to indicate a particular game outcome at a gaming device. The game ensemble disclosed in this document comprises a plastic sphere that can contain a magnetic element as a core. It is also described that ball detectors associated with the receiving locations, and in communication with a controller, can be used to determine when a sphere has been received by a receiving location. On the other hand, this document does not disclose devices intended for creating illusion. The devices disclosed in this document require electronic equipment, power supply and a number of extra components which are not light, portable, and applicable to the illusion industry at large.

U.S. Pat. No. 4,373,725 refers to a magnetic control of a ball on a pinball playfield by an electromagnet located on the playfield and a mechanism manually operable by a player for energizing the electromagnet. The energizing mechanism includes a first switch external on the playfield operable by the player and a second switch on the playfield which is activated by a ball hitting a target thereon. The first and second switch are connected in series with the electromagnet to control the latter. A timing mechanism is provided to limit the energization of the electromagnet to a predetermined time period. The balls disclosed and claimed in this document are automatically guided; on the other hand, this document neither discloses nor claims the specific use of plastic balls containing a magnetic core. The control also requires power, electronic components and cannot be implemented in the illusion industry.

U.S. Pat. No. 6,431,548 discloses a compact game playing apparatus that is easy to carry and use when traveling. The apparatus contains an elongate sheet coupled to two spindles. A plurality of game playing surfaces are printed on the elongate sheet, and rotation of the spindles operate to align a selected one of these game playing surfaces with a window in the apparatus housing. A magnet attracting metal surface is positioned below the exposed game playing surface so that game pieces, which include magnets, may be placed on the game playing surface without being inadvertently displaced. The housing further contains an integral die throwing apparatus, and an integral drawer for holding game pieces when not in use. The specification of this patent clearly teaches that a "game piece preferably has a cylindrical shape and is made of plastic" and that "the underside of the game piece has a hollow recess in which a magnet is carried." On the other hand, this document neither discloses nor claims the specific use of plastic balls containing a magnetic core.

The devices for creating a sense of randomness in the related art with control in a lottery machine involves controlling what is written on the elements, either externally or internally. Markings are repeated numbers, repeated patterns, patterned codes or set patterns. However, they do not allow an observer to read these markings continuously or the illusionist to read them out loud, otherwise the pattern would be detectable. Thus, the state of the art fails to teach a lottery device intended for illusion capable of forcing the outcome of one or more elements. Neither the process of creating a device with these capabilities is reported in the art.

BRIEF SUMMARY OF INVENTION

The present application refers to a device comprising four distinct modules.

The first module is a set of elements (spheres or the like) comprising objects created by means of any method, including but not limited to three-dimensionally (3D) printed as a single piece. These elements will not contain any material that is magnetically attracted.

The second module is a set of elements that is externally similar to the first one, but is made of, or comprise, material that is magnetically attracted such as a magnet or iron in its interior. A notable feature here is that said elements will be attracted to a magnet, while the first set will not. It can be a single element or more with such properties.

The third module is a cage. Its production process can be any, including 3D printing it in a single piece.

The fourth module is the trap. In a traditional lottery device (also referred to as a bingo set), spheres are trapped randomly, failing to allow control by the illusionist. In the proposed device a trap is used, wherein a part thereof is also manufactured in a single step, without the need for joint welds, with a built-in hidden magnet.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
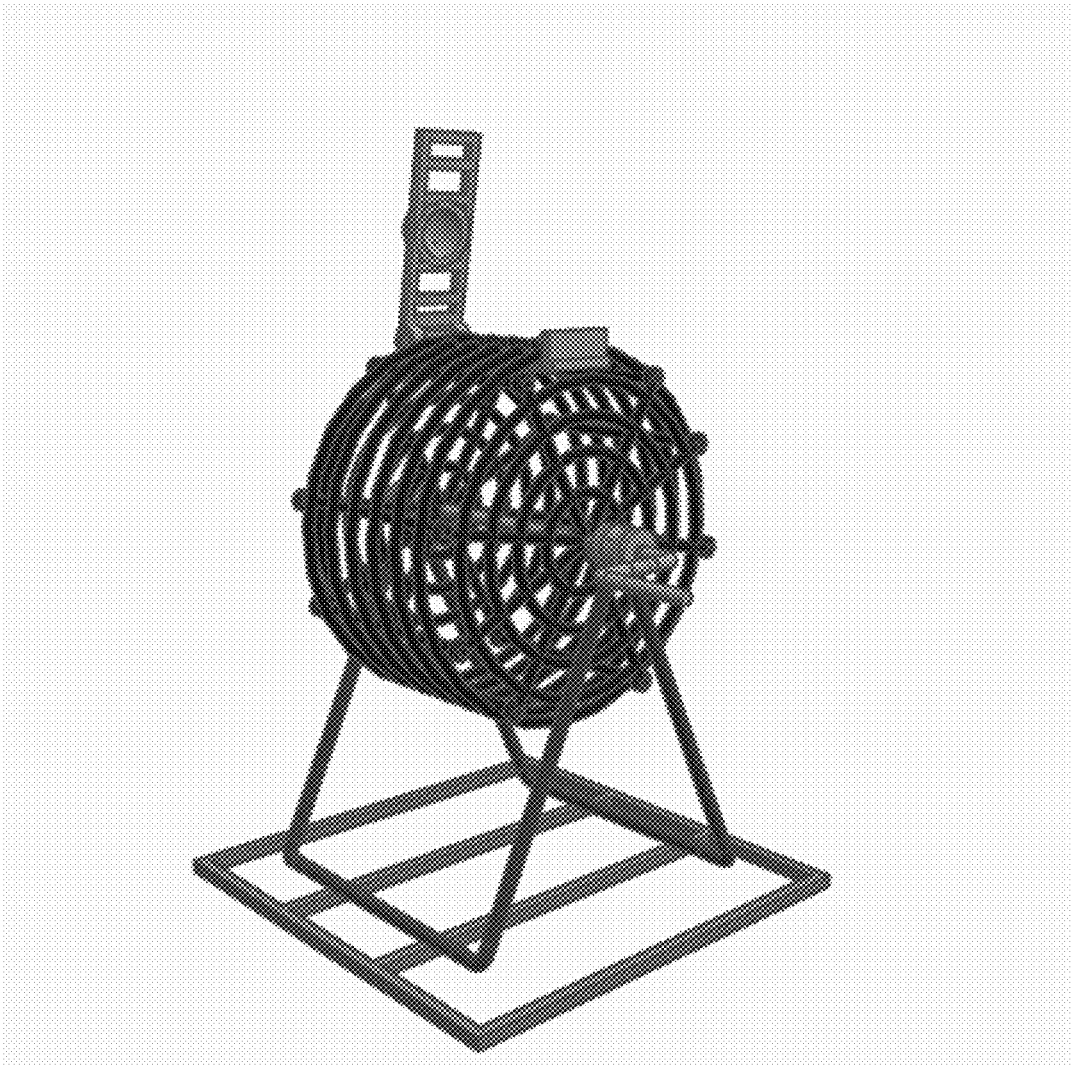
FIG. 1 shows a perspective view of one embodiment of a bingo set according to the present application.
Figure 2:
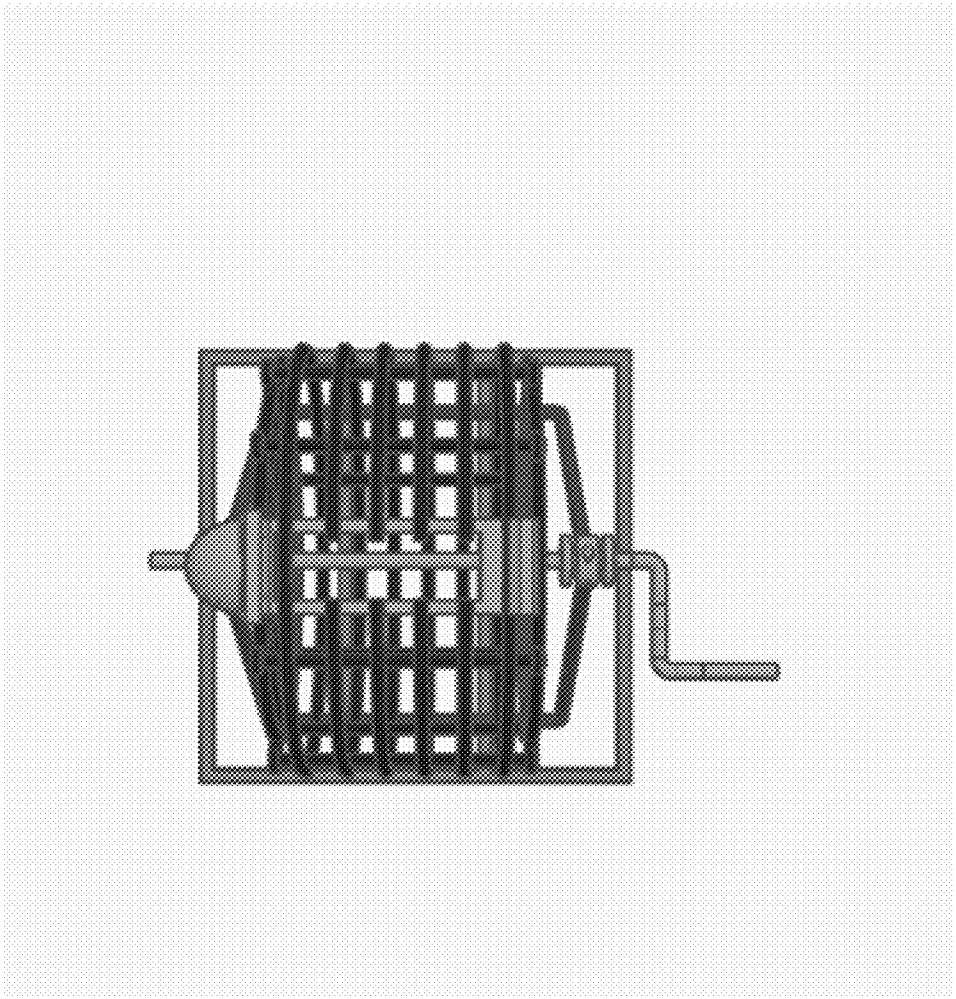
FIG. 2 shows a top perspective view of the same embodiment of a bingo set according to the present application.
Figure 3:
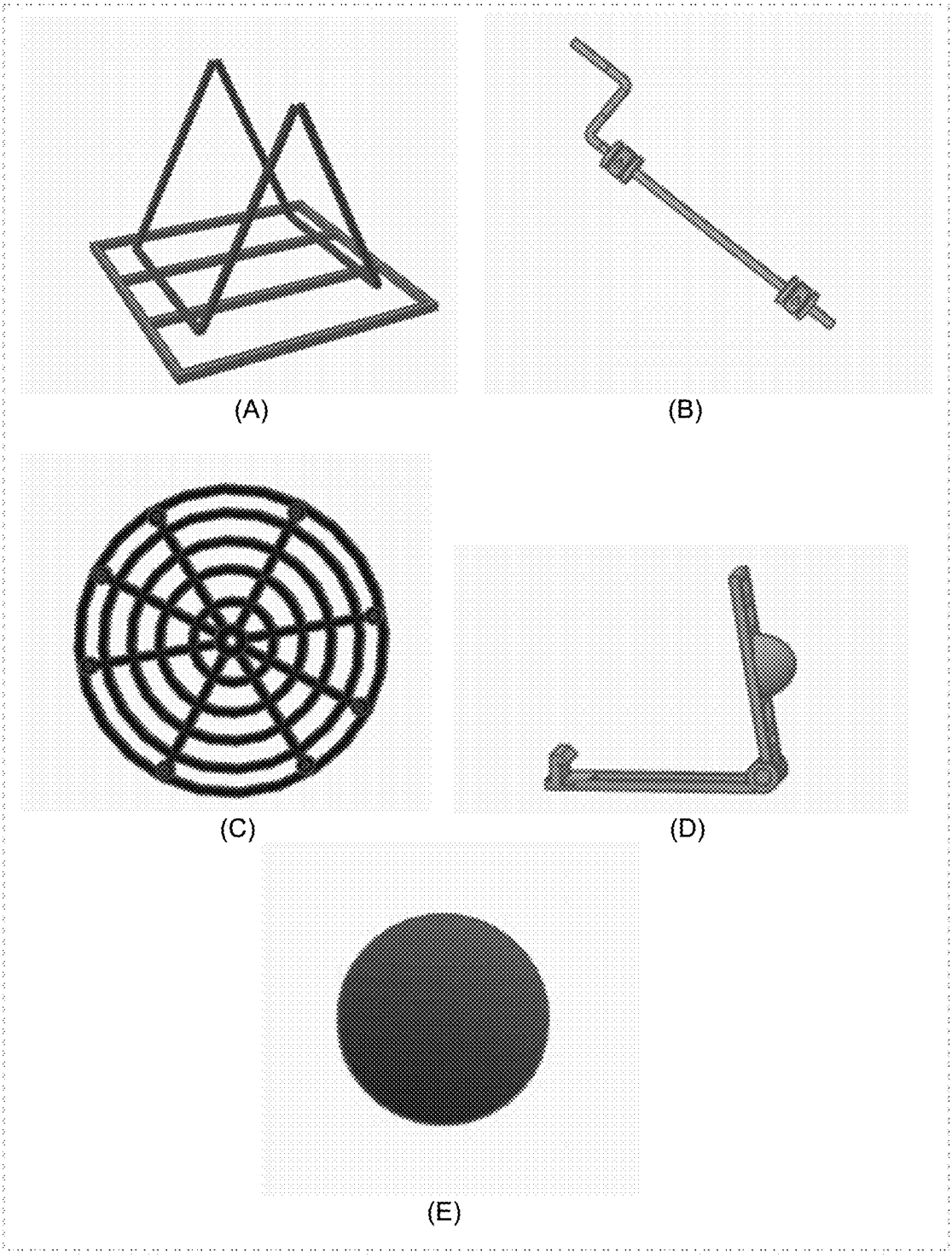
FIG. 3 shows an exploded view of the same embodiment: (A) base, (B) rolling axis about which a cage rotates, (C) cage, (D) trap, (E) sphere.
Figure 4:
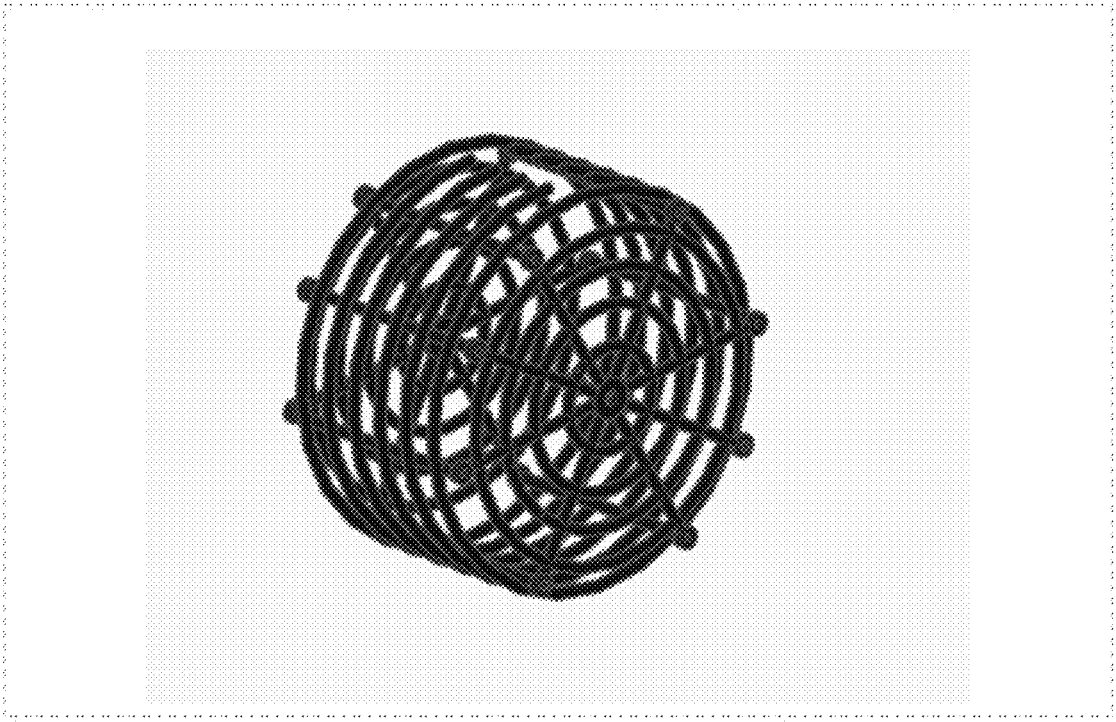
FIG. 4 shows a perspective view of the cage (C).
Figure 5:
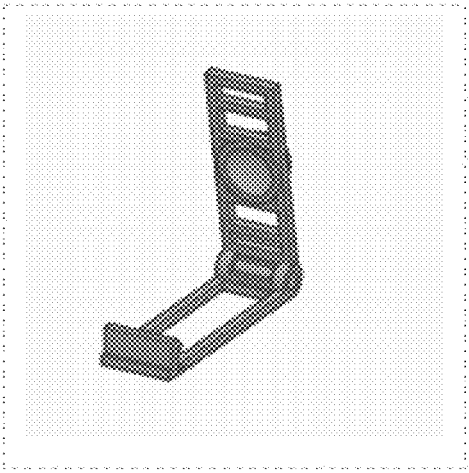
FIG. 5 shows a perspective view of the trap (D).
Figure 6:
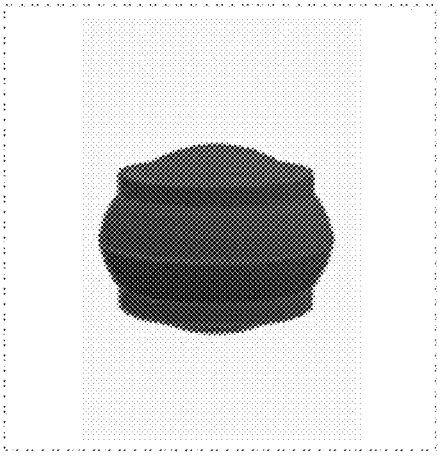
FIG. 6 is a representation of the internal hollow for a sphere (E).

The present invention refers to a device that is an ensemble comprising four distinct elements. It can be considered as an illusion machine, for it creates the illusion of randomness wherein actually referring to a deterministic event.

The first element (spheres or the like) is a set of, for example, 59 spheres that are 3D printed (or objects otherwise produced) made as a single piece, shallow and/or hollow. Thus, externally they are parts like any other lottery elements, printed in place as a single body. In this example, the outer markings of the spheres read 1 to 59 to allow the identification of the spheres.

The second element is made in similar fashion to the first, externally marked with the number 60 to allow its identification and containing an element that is magnetically attracted.

The third module is the body of the ensemble. In the embodiment where the first and second elements contain magnets or the like. It can be 3D printed or made by any other production suitable process. In the case of plastics, it is to be painted in black (the traditional color of such bingo ball cage) or in metallic colors that create the illusion of ferromagnetic metal, since laymen may not know that not all metals react strongly to magnetism.

The fourth module is the trap, which may include a recess sized and dimensioned similar to the spheres. In a traditional lottery like device, elements are randomly entrapped into the trap, without allowing control by the illusionist. The device according to the present application comprises a trap wherein the body can also be printed in a single piece, without the need for welding joints, with an embedded magnet or the like. It can also be printed in several pieces. While the prior art trap is created for randomness, the one according to the present application is created to attract specific spheres and do not allow the said target spheres to leave.

If the second element has a magnet core, or are multiple ones with an iron core, once they get close enough to the magnetic field generated by the trap, they are no longer able to escape. After that, it becomes up to the illusionist to choose who will decide to stop the spinning, to ask a volunteer when to stop or to spin the device a few more times. Once he gets a visual confirmation that there is already an element that will not come off, the illusionist may, for example, ask a volunteer to say "stop" at any moment. Since the illusionist has already created the illusion of randomness and waited for the target element to be trapped, he is sure that it is still in the trap.

To have visual confirmation, one may look at the moment when the trap is upside down, the furthest away from the floor as possible. At that instant no element should be trapped therein based on the force of gravity, unless it is attracted by the magnet inside.

The following detailed description shows specific embodiments in which the invention may be practiced. It is to be understood that other embodiments may be used, and that structural changes may be made without departing from the scope of the present invention.

Choice of Elements

A number of different methods can be used to produce the choice elements, including but not limited to additive manufacturing. A number of different materials can be used for the outer layers, including but not limited to PLA, ABS or Aluminum.

The elements can be created in one piece or assembled from several pieces.

The elements can be solid, hollow, with one or multiple cavities or filled with any kind of material to provide the desired weight. The desired weight can be chosen to allow spectators to compare multiple elements.

The elements to be forced can contain or be made of magnets or any material that is magnetically attracted. Examples of such embodiments are a magnet in the form of a sphere, a PLA sphere containing a magnet, a sponge ball containing a magnet and a PETG cube painted with ferromagnetic paint.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. An illusion ensemble for allowing an operator to create an illusion of randomness while providing a deterministic event that is non-powered, non-electric, and portable, comprising:

a plurality of spherical elements, a first portion of the spherical elements being non-magnetic elements not comprising any magnetic material, and a second portion of the spherical elements being at least one magnetically attracted element having a weight, appearance, and size similar to the non-magnetic elements, wherein a number of the spherical elements is greater than fifty;

a cage configured to spin the plurality of spherical elements therein, the cage being formed of a non-ferromagnetic material;

a portable base configured to support the cage, and a rolling axis about which the cage rotates; and a trap sized and dimensioned similar to the spherical elements and comprising a hidden magnet configured to attract and trap only the at least one magnetically attracted element of the spherical elements when a spinning of the cage is stopped, wherein a subsequent spinning of the cage after the trap has attracted and trapped only the at least one magnetically attracted element maintains the at least one magnetically attracted element in the trap;

wherein a strong illusion of randomness is created for all of the spherical elements inside the cage of the illusion ensemble, in which only one of the at least one magnetically attracted element of the spherical elements is trapped by the trap, thereby creating the deterministic event with zero probability that any of the non-magnetic elements are trapped.

2. The illusion ensemble of claim 1, wherein the at least one magnetically attracted element is one of a plurality of magnetically attracted elements.

3. The illusion ensemble of claim 1, wherein:

each of the plurality of non-magnetic elements and the at least one magnetically attracted element comprise an internal or external marking for identification of a corresponding one of the spherical elements.

4. The illusion ensemble of claim 1, wherein the cage is formed by three-dimensional printing and is a plastic material.

5. The illusion ensemble of claim 4, wherein the cage is configured to have a ferromagnetic material appearance.

6. The illusion ensemble of claim 1, wherein each of the spherical elements comprises an outer layer of polylactide (PLA), acrylonitrile butadiene styrene (ABS), or aluminum.

7. The illusion ensemble of claim 1, wherein the at least one magnetically attracted element comprises a magnet in the form of a sphere, a polylactide (PLA) sphere containing a magnet, a sponge ball containing a magnet, or a polyethylene terephthalate glycol (PETG) cube painted with a ferromagnetic paint.

8. A method for enabling an operator to create an illusion of randomness while providing a deterministic event, comprising:

providing an illusion ensemble that is portable, non-electric, and non-powered, comprising:

a plurality of spherical elements, a first portion of the spherical elements being non-magnetic elements not comprising any magnetic material, and a second portion of the spherical elements being at least one magnetically attracted element having a weight, appearance, and size similar to the non-magnetic elements, wherein a number of the spherical elements is greater than fifty;

a cage configured to spin the plurality of spherical elements therein, the cage being formed of a non-ferromagnetic material;

a portable base configured to support the cage, and a rolling axis about which the cage rotates; and a trap sized and dimensioned similar to the spherical elements and comprising a hidden magnet configured to attract and trap only the at least one magnetically attracted element of the spherical elements; and spinning the cage having the plurality of non-magnetic spherical elements and the magnetically attracted spherical element therein until the magnetically attracted spherical element is positioned in the trap; and performing a subsequent spinning of the cage after the trap has attracted and trapped only the at least one magnetically attracted spherical element while maintaining the at least one magnetically attracted spherical element in the trap; and stopping the spinning of the cage such that a strong illusion of randomness is created for all of the elements inside the cage of the illusion ensemble, in which only the magnetic spherical element is actually trapped when the spinning of the cage is stopped, thereby creating the deterministic event with zero probability that any of the plurality of non-magnetic spherical elements are trapped.

9. The method of claim 8, wherein the magnetically attracted element is one of a plurality of magnetically attracted elements.

10. The method of claim 8, wherein each of the plurality of non-magnetic elements and the magnetically attracted element comprise an internal or external marking for identification of the elements.

11. The method of claim 8, wherein the cage is formed by three-dimensional printing and is a plastic material.

12. The method of claim 11, wherein the cage is painted to have a ferromagnetic material appearance.

13. The method of claim 8, wherein each of the spherical elements comprises an outer layer of polylactide (PLA), acrylonitrile butadiene styrene (ABS), or aluminum.

14. The method of claim 8, wherein the at least one magnetically attracted element comprises a magnet in the form of a sphere, a polylactide (PLA) sphere containing a magnet, a sponge ball containing a magnet, or a polyethylene terephthalate glycol (PETG) cube painted with a ferromagnetic paint.

15. An illusion device for creating an illusion of randomness while providing a deterministic event that is non-powered, non-electric, and portable, comprising:

a plurality of elements, a first portion of the elements being non-magnetic elements not comprising any magnetic material, and a second portion of the elements being at least one magnetically attracted element having an appearance and size similar to the non-magnetic elements;

a cage configured to spin the plurality of elements therein, the cage being formed of a non-ferromagnetic material;

a trap sized and dimensioned similar to the elements and comprising a hidden magnet configured to attract and trap only the at least one magnetically attracted element of the elements when a spinning of the cage is stopped, wherein a strong illusion of randomness is created for all of the elements inside the cage of the illusion ensemble, in which only one of the at least one magnetically attracted element of the elements is trapped by the trap, thereby creating the deterministic event with zero probability that any of the non-magnetic elements are trapped.

16. The illusion device of claim 15, wherein each of the plurality of elements is spherical.

17. The illusion device of claim 15, further comprising a portable base configured to support the cage, and a rolling axis about which the cage rotates.

* * * * *